US005396917A

United States Patent [19]

Hazinski et al.

[11] Patent Number: 5,396,917

[45] Date of Patent: Mar. 14, 1995

[54] SELF ERECTING HIGH TOP TENT

[76] Inventors: Daniel P. Hazinski, 4481 SW. 34th Ter., Ft. Lauderdale, Fla. 33312; Sidney Samole, 6755 SW. 152nd St., Miami, Fla. 33157

[21] Appl. No.: 191,370

[22] Filed: Feb. 3, 1994

[51] Int. Cl.[6] ..... E04H 15/40

[52] U.S. Cl. ..... 135/104; 135/106

[58] Field of Search ..... 135/102, 104, 106, 905

[56] References Cited

U.S. PATENT DOCUMENTS 3,990,463 11/1976 Norman ..... 135/104

4,858,634 8/1989 McLeese .

5,014,728 5/1991 Arnold ..... 135/104

5,163,461 11/1992 Ivanovich .

*Primary Examiner*—Lanna Mai

[57] ABSTRACT

A pop-up tent structure is provided with a center height increasing portion which provides for stand-up height in a self erecting tent. The extra height is attained without sacrificing a conveniently small ground size, and yet provides for ease of assembly and a small storage configuration pop-up rods are provided in sleeves at the tents center portion. Pop-up air vents are also provided in the tent structure.

7 Claims, 2 Drawing Sheets

SELF ERECTING HIGH TOP TENT

BACKGROUND

This invention relates in general to the field of outdoor tents and in particular to the field of self erecting tents having an integral frame with attached fabric covering and configured to stand up height.

PRIOR ART

The prior art in the field of self erecting tent structures uses a single continuous rod or wire to form the supporting frame. The resulting tent having two loop-like substructures crossing each other at a right angle whereby one loop forms the tent floor and the other forms the tent roof and walls. The spring tension in the single rod, which is joined by a single connector and supplies-the forces needed to form the tent fabric into a tent structure. The self erecting feature of the tent being such that when thrown up into the air the tent transforms from a circular shape to that of a fully formed tent when it settles onto the ground.

In the above described prior art, a relatively low lying tent is effectuated. That is, a tent having a relatively low height as compared to its length and width. While such tents are completely adequate for sleeping purposes, some inconvenience is experienced when the users attempt to stand up, for example, when dressing.

Accordingly, it is a primary object of the present invention to provide a self erecting, pop-up tent having a center section which when erected allows a person to fully stand up in the tent, yet, the tent is not inconveniently long.

Another object of the present invention is to provide a self erecting, pop-up tent having a pop-up center section.

Another object of the present invention is to provide a high-top self erecting tent which is capable of being folded into a small circular shape for storage and transport.

SUMMARY OF THE INVENTION

The above objects as well as others are achieved by the present invention in accordance with a fair reading and interpretation of this specification including all parts hereof including the drawings, claims and abstract.

A single rod or wire is arranged and connected by a single connector and together with an attached fabric structure, forms a self erecting pop-up tent. A pair of additional rods or wires are employed to form a pop-up center portion having additional height above the transverse loop of the base tent. Each of the additional rods extend from a location on the transverse loop to an approximate geometric center of the tent. Thus, the two additional rods have a total of four end points which extend from the transverse loop; two from one side of the transverse loop and two from the other side of the transverse loop. Each of the four end points are separated from each other by approximately the same distance and are located along a common horizontal plane. The middle portion of the two additional rods extend convexly upward above the top height of the transverse loop. The two additional rods are angled toward each other such that the apex of the convexly shaped rods meet each other at the approximate geometric center of the tent. The additional rods are contained within sleeves provided in the tent fabric.

The spring force in the additional rods cause the tent fabric to form to the curvature of the sleeves and thereby provides a center section of the tent having increased height. Further, the spring force in the additional rods allows the center section of the tent to pop-up or pop-down by a simple pulling or pushing action by a person when the tent is being erected for use or being closed for storage. Thus, the present invention provides a pop-up tent having a height which has never before been achieved without sacrificing: convenience of erecting and folding; storage size; and, overall length and width.

BRIEF DESCRIPTION OF THE DRAWINGS

Various other objects, advantages and features of the present invention will become apparent to those skilled in the art from the following discussion taken in conjunction with the following drawings in which.

DETAILED DESCRIPTION OF THE PREFERRED EMBODIMENTS

Figure 1:
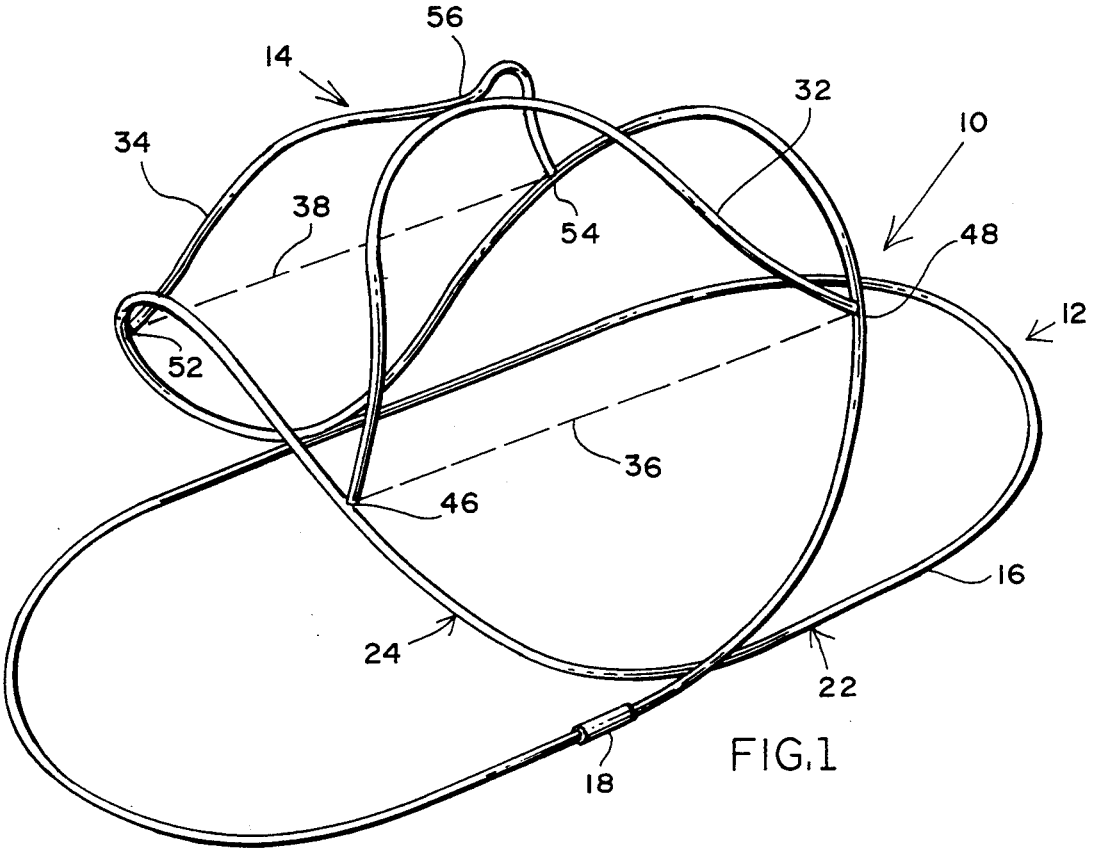
FIG. 1 is an isometric view of the rod frame of the present invention showing the additional rod rods forming the center pop-up portion of the self erecting tent structure.

As required, detailed embodiments of the present invention are disclosed herein; however, it is to be understood that the disclosed embodiments are merely exemplary of the invention which may be embodied in various forms. Therefore, specific structural and functional detail disclosed herein are not to be interpreted as limiting, but merely as a basis for the claims and as a representative basis for teaching one skilled in the art to variously employ the present invention in virtually any appropriately detailed structure.

Reference is now made to the various figures of the drawings, wherein like characteristics and features of the present invention shown on the various figures are designated by the same reference numerals.

FIG. 1 shows, in perspective, the rod or wire frame of the pop-up tent structure 10 illustrating the base, self erecting, single rod, frame 12 together with the additional frame 14 forming the pop-up center portion when the rod frame is fitted to tent fabric and when the tent structure 10 is in an erected mode. The base portion 12 comprises a single rod or wire 16 which may be made from any appropriate material having a spring like characteristic such as metal wire, fiberglass or the like, joined at its ends by a single connector 18 forming an endless loop structure having a first lower loop 22 and a second upper loop 24. For purposes of this description the lower loop 22 is sometimes referred to as the ground loop and the upper loop 24 is sometimes referred to as the transverse loop. Thus, the ground loop 22 is intended to lie flat against the ground where the tent is placed. The transverse loop 24 forms the height structure which provides the tent 10 with its vertical height and shape.

Figure 4:
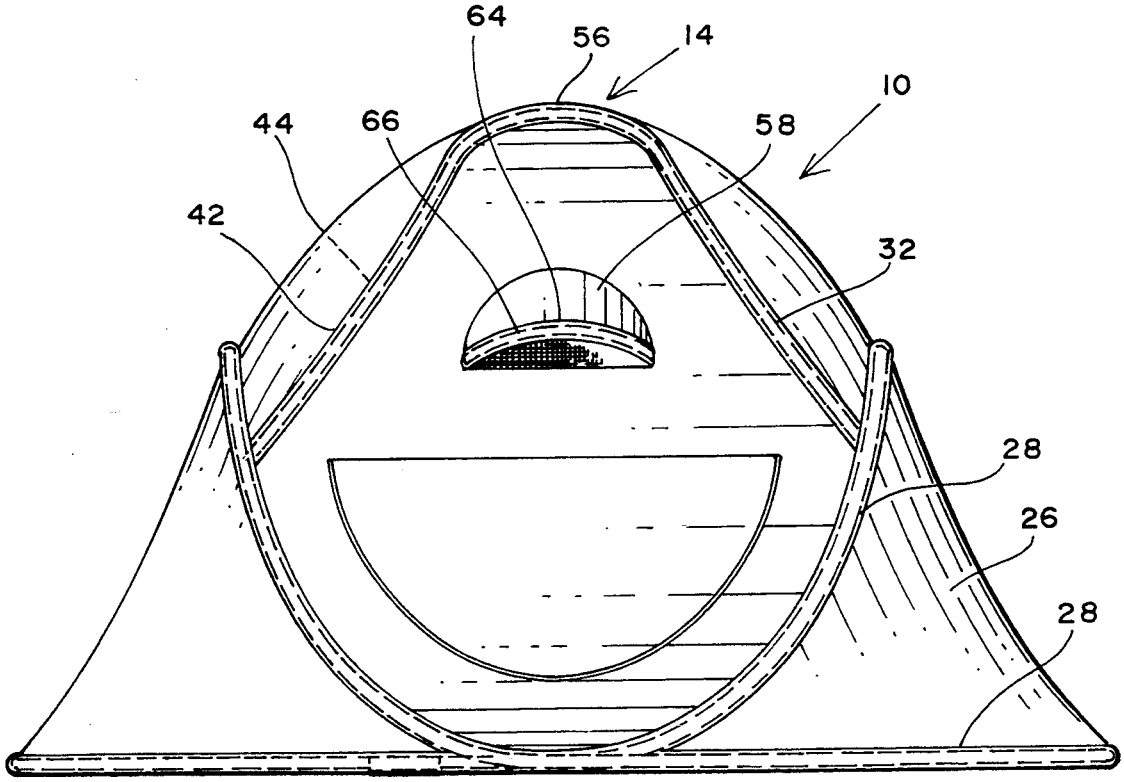
FIG. 4 is a side view of the present invention with the tent fabric attached.

As seen in FIG. 4, tent fabric 26 is fitted to the ground 22 and transverse 24 loops and forms the protective fabric shell of the tent 10. A substantially continuous sleeve 28 following the shape of the loops 22 and 24 as shown in FIG. 1 is provided in the tent fabric 26. Thus, the combination of the spring tension in rod 16 and the constraining configuration of sleeve 28 forms the tent 10 into the taut, self erecting and standing shape shown in FIG. 4.

Referring again to FIG. 1, a first rod 32 extends between opposite sides of the transverse loop 22, along a first horizontal line. And, a second wire rod 34 extends between opposite sides of the transverse loop 22 along a second horizontal line (for convenience shown by the imaginary dashed lines 36 and 38, respectively). The imaginary lines 36 and 38 lie in the same imaginary horizontal plane. The apex of rods 32 and 34 are angled inward toward each other and meet at the approximate geometric center 56 of transverse loop 24 or tent 10. The upwardly curved shape of rods 32 and 34 shown in FIG. 1 is effectuated when rods are fitted to tent fabric 26 and the tent 10 is erected. Rods 32 and 34 are fitted within sleeves 42 and 44 provided in the tent fabric 26 (FIG. 4). Thus, the shape of the tent 10 shown in FIG. 4 is also due to the spring tension of the rods 32 and 34 and the constraining configuration of the sleeves 42 and 44.

Figure 2:
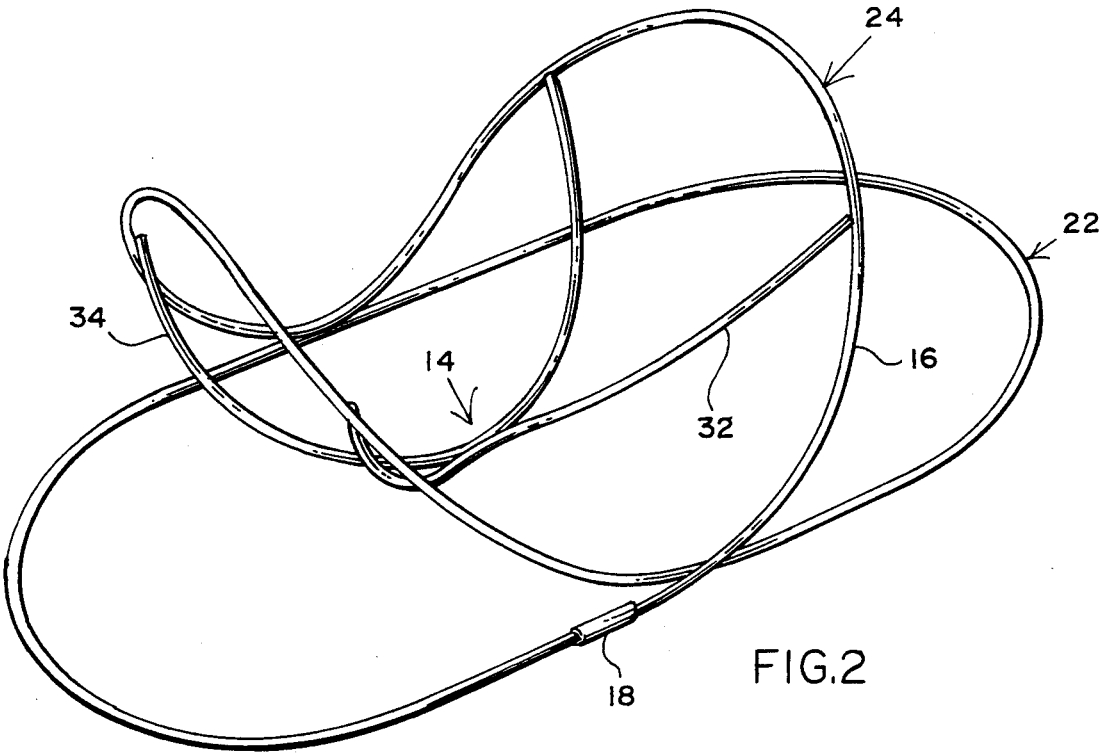
FIG. 2 is an isometric view of the rod frame of the present invention with the center portion being popped down.

FIG. 2 shows the shape of rods 32 and 34 either before the center portion 14 of tent 10 is popped up into the height increasing feature of tent 10; or, after it is collapsed and ready for tent 10 to be folded into its storage configuration. The constraining action of sleeves 42 and 44 in combination with the spring force in rods 32 and 34 also provide for the popped-down configuration shown in FIG. 2.

The end points 46, 48, 52 and 54 of rods 32 and 34 need not be physically attached to loop 22. Therefore, it is not necessary to provide a pivot attachment, when center portion 14 is either popped up or down.

Because of the elastic nature and the endless loop structure formed by the single rod or wire 16 joined at its end by a single connector 18 the first lower loop 22 and the second upper loop 24 together with the accompanying fabric 26 can be readily folded in upon themselves to form four loops of smaller diameter. The elastic energy of this folded structure is easily contained by a strap and a zippered cover so that the complete structure is portable and easily stored in a closet or the trunk of an automobile. When the folded structure is removed from its storage cover, the stored elastic energy in rod 22 allows the structure to pop-up, then the center portion 14 is popped up to form the final configuration of tent 10 with no further action from the user, thus providing the self erecting feature which makes the tent structure 10 very convenient to use. As previously stated, the center portion 14 does not interfere with pop-up feature of tent 10 nor its pop-down feature, nor its round and flat storage configuration.

Figure 3:
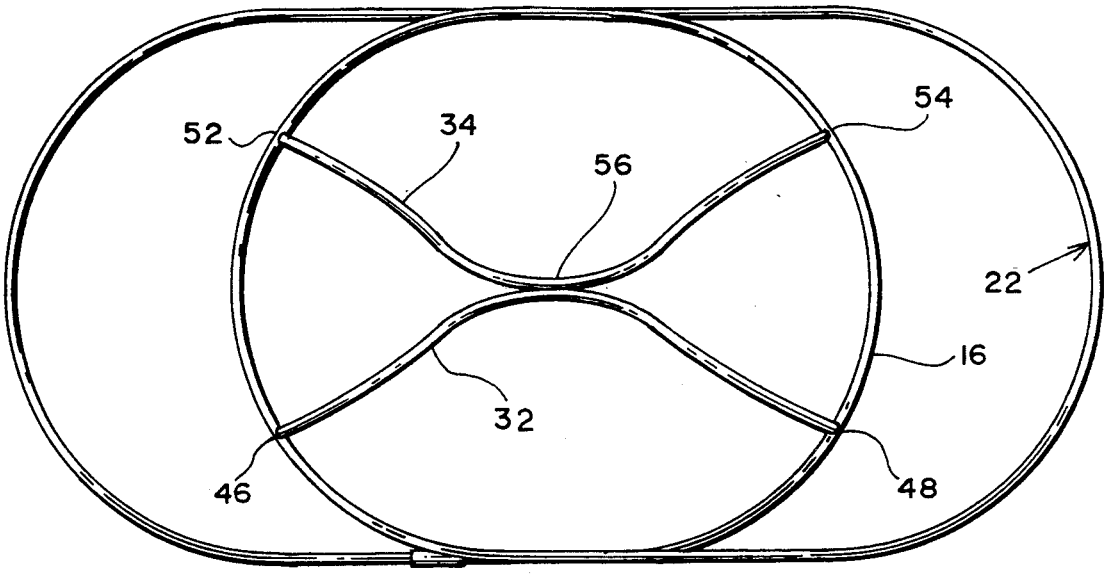
FIG. 3 is a top view of the rod frame of FIG. 1.

FIG. 3 shows a top view of the framework of FIGS. 1 and 2. In this figure, the looped shape of loops 22 and 24 can be seen. The location of the ends of rods 32 and 34 at their juncture to loop 24 can also be seen. Also, shown in FIG. 3, is the meeting of the apex of rods 32 and 34 at the approximate geometric center 56 of tent 10.

In order to pop-up or pop-down, the center height increasing portion 14 of tent 10 it is a simple matter for a person to push the same up from the inside of tent 10 or to push the same down from the outside of tent 10 by pressure exerted by the person's palm or rods 32 and 34. When center portion 56 is popped down, the same is moved out of the way for the tent 10 to be folded into its round and flat storage shape.

In FIG. 4, additional pop-up and pop-down features of the inventive tent 10 are shown. One or more air vents 58 can be adapted to the center portion 14. These may comprise an inverse "U" shaped piece in the tent wall. The bottom part of vent 58 may be sleeved 64 and fitted with a wire or rod 66 having a length slightly greater than the horizontal length of vent 58. To open the vent 58, rod 66 is simply grasped and pulled outward. The spring force in rod 66 maintains an opening 68 through which air may be vented from the tent 10. To close vent 58, the rod 66 is pushed inward and is maintained in this position by its spring force.

While the invention has been described, disclosed, illustrated and shown in certain terms or certain embodiments or modifications which it has assumed in practice, the scope of the invention is not intended to be limited nor should it be deemed to be limited thereby and such other modifications or embodiments as may be suggested by the teachings herein are particularly reserved especially as they fall within the breath and scope of the claims here appended and in particular as applied to any device or mechanism involving rotational motion.

I claim:

1. A self erecting tent having a pop-up, height increasing center portion comprising a first elastic rod means joined at ends thereof by a single connector forming an endless frame comprising a first lower loop and a second upper loop, said second loop arranged transverse to said first loop, a fabric covering fitted over said endless frame, first sleeve means provided in said fabric covering for fitting therein said rod and for constraining said rod into said lower and upper loop configuration and whereby said elastic rod and said first sleeve means form said fabric into a taut, self erecting, tent structure, second and third elastic rod means, second the third sleeve means in said fabric covering said second and third rod means being fitted therein, said second and third sleeve means and said second and third rod means forming a convexly shaped, pop-up center portion of said tent emanating from opposite sides of said upper loop, each reaching an apex at an approximate top geometric center of said tent.

2. The tent apparatus of claim 1 wherein said emanating ends of said second and third sleeves and said rods contained therein are located at the approximate same vertical height when said tent is erected.

3. The tent apparatus of claim 2 wherein each apex of said second and third rods are located above said emanating ends when said tent is erected.

4. The tent apparatus of claim 3 wherein said tent fabric tautly covers said second and third rods when said tent is erected.

5. The tent apparatus of claim 1 including a vent opening in the fabric covering of said tent, a pop-up fabric covering over said vent, a fourth elastic rod fitted to said vent covering.

6. The tent apparatus of claim 5 wherein said vent covering has a fourth sleeve means fitting therein said fourth elastic rod.

7. The tent apparatus of claim 6 wherein said fourth rod has a length slightly larger than said vent opening.

* * * * *